US005211860A

United States Patent [19]

Doner et al.

[11] Patent Number: 5,211,860

[45] Date of Patent: * May 18, 1993

[54] GREASE COMPOSITION

[75] Inventors: John P. Doner, Sewell; Andrew G. Horodysky, Cherry Hill; John A. Keller, Pitman, all of N.J.

[73] Assignee: Mobil Oil Corporation, Fairfax, Va.

[ * ] Notice: The portion of the term of this patent subsequent to Jan. 28, 2009 has been disclaimed.

[21] Appl. No.: 825,683

[22] Filed: Jan. 27, 1992

Related U.S. Application Data

[63] Continuation-in-part of Ser. No. 614,564, Nov. 14, 1990, Pat. No. 5,084,194, which is a continuation of Ser. No. 14,091, Jul. 28, 1987, abandoned, which is a continuation of Ser. No. 861,738, May 7, 1986, abandoned, which is a continuation of Ser. No. 774,873, Sep. 12, 1985, abandoned, which is a continuation of Ser. No. 641,077, Aug. 15, 1984, abandoned, which is a continuation-in-part of Ser. No. 587,328, Mar. 7, 1984, abandoned.

[51] Int. Cl.[5] ..... C10M 117/04; C10M 139/00

[52] U.S. Cl. ..... 252/32.7 E; 252/41; 252/49.6

[58] Field of Search ..... 252/49.6, 32.7 E, 41

[56] References Cited

U.S. PATENT DOCUMENTS

| | | | |
|---|---|---|---|
| 2,397,956 | 4/1946 | Fraser | 252/40 |
| 2,450,220 | 9/1948 | Ashburn et al. | 252/41 |
| 4,328,113 | 5/1982 | Horodysky et al. | 252/49.6 |
| 4,406,802 | 9/1983 | Horodysky et al. | 252/49.6 |
| 4,961,868 | 10/1990 | Doner et al. | 252/32.7 |
| 5,084,194 | 1/1992 | Doner et al. | 252/49.6 |

OTHER PUBLICATIONS

H. M. Dickinson, "Significance of the ASTM Dropping Point of Lubricating grease", pp. 13–14, (PA 1963).

Smalheer "Lubricant Additives", (OH, 1967) pp. 1–11.

ASTM D2265–78, "Standard Test Method for Dropping Point of lubricating Grease over Wide Temperature Ranges", pp. 83–85 (1983).

*Primary Examiner*—Ellen McAvoy

*Attorney, Agent, or Firm*—Alexander J. McKillop; Malcolm D. Keen; Jessica M. Sinnott

[57] ABSTRACT

Improved grease compositions, wherein the grease is thickened with a hydroxy-carboxylate soap grease thickener, preferably a lithium 12-hydroxy stearate, and a means for increasing the dropping point which is a borated n-hydrocarbyl propylenediamine and optionally compounds containing phosphorus and/or sulfur moieties are disclosed.

23 Claims, No Drawings

GREASE COMPOSITION

CROSS REFERENCE

This application is a continuation-in-part of copending application Ser. No. 07/614,564 filed on Nov. 14, 1990, now U.S. Pat. No. 5,084,194; which is a continuation of copending application 07/014,091, filed on Jul. 28, 1987, abandoned, which is a continuation of copending application 06/861,738 filed on May 7, 1986, abandoned, which is a continuation of copending application 06/774,873 filed on Sep. 12, 1985, abandoned, which is a continuation of copending application 06/641,077, filed on Aug. 15, 1984, abandoned, which is a continuation-in-part of copending application Ser. No. 06/587,328, filed Mar. 7, 1984, now abandoned, which are all incorporated herein by reference in their entireties.

BACKGROUND OF THE INVENTION

1. Field of the Invention

The invention is concerned with a novel grease composition. It more particularly relates to a synergistic grease composition comprising oil, hydroxy-containing soap thickener and borated diamine, and optionally containing phosphorus and sulfur moities.

2. Discussion of the Prior Art

Greases thickened with metal hydroxystearates, specifically lithium hydroxystearates, are well known, as is the use of "additive packages". These packages are known to contain phosphorous and sulfur compounds as well as other additives that impart antioxidant, detergent, dispersant, etc. properties to such greases.

From U.S. Pat. No. 4,328,113 it is also known that borated amines, such as borated hydrocarbyl mono-and diamines, are useful as friction reducers in lubricants, especially in lubricating oils. However, no prior art is known that teaches or suggests the unexpected results obtained by combining the known additive packages mentioned herein with the particular thickener and the borated amines of the invention.

SUMMARY OF THE INVENTION

In accordance with the invention, there is provided an improved grease composition comprising a major proportion of a grease and a minor amount of a compound prepared by reacting an amine of the formula

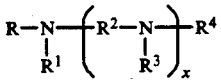

wherein x is 0 or 2, R, $R^1$, $R^3$ and $R^4$ are hydrogen or $C_1$ to $C_{30}$ hydrocarbyl groups including alkyl groups containing 6 to 20 carbon atoms, hydroxyalkyl groups containing 2 to 4 carbon atoms, polyalkoxylated groups containing 6 to 20 carbon atoms and the corresponding members containing sulfur or additional oxygen, at least one of which is a hydrocarbyl group, i.e., is not hydrogen, and $R^2$ is a $C_2$ to $C_4$ alkylene group, with a boron compound which may be boric acid, boric oxide, a metaborate, a similar boron source or an alkyl borate of the formula $$(R^5O)_yB(OH)_z$$

wherein y is 1 to 3, z is 0 to 2, their sum being 3, and $R^5$ is an alkyl group containing from 1 to 6 carbon atoms, the improvement comprising thickening said grease with a hydroxy-containing soap thickener. The presence of phosphorus and sulfur moieties provides an even higher dropping point. The alkyl borates include the mono-, di- and trialkyl borates, i.e., those having the methyl, ethyl, propyl, butyl, pentyl and hexyl groups.

Preferably the amine is overborated. By "overborated" is meant the presence in the borated product of more than a stoichiometric amount of boron.

H. M. Dickinson "Significance of the ASTM Dropping Point of Lubricating Greases", NLGI Spokesman pp. 13–14 (1963) teaches that the dropping point test gives a value higher than the maximum operating temperature. For example, the prior art lithium-type grease has a dropping point of about 370° F. (188° C.) and the corresponding suggested maximum useable temperature is about 300° F. (148° C.). Although each type of grease has its own characteristic dropping point, treating a grease to improve the dropping point can enable a grease to be defined as having high temperature properties. As described in Dickinson, a 55° F. increase in average dropping point (corresponding to a 65° F. increase in maximum useable temperature) of a calcium-type grease shifts the designation of the grease to its consideration as a high temperature grease.

An important feature of the invention is the discovery of a means for increasing the dropping point of a hydroxy-containing carboxylate soap thickened grease by at least about 30° C. (54° F.). The advantage of this is the improvement in the high temperature performance of the grease such that these greases will perform at significantly higher temperatures than the known greases.

DESCRIPTION OF SPECIFIC EMBODIMENTS

The borated amines of the invention can be made by reacting an amine of the above formula with a boron compound such as boric oxide, boric acid, an alkyl borate or mixtures of these. The resulting products are believed to be, primarily, borated amines, but other possible products present are metaborates and the like. Included within the scope of the amines as set forth in the above formula are (1) the primary amines such as hexylamine, octylamine, nonylamine, decylamine, dodecylamine, tetradecylamine, octadecylamine, eicosylamine, triacontylamine, oleylamine, stearylamine, isostearylamine, tallowamine and soyamine, (2) the secondary amines corresponding to (1) having both groups the same or having mixtures of such groups, (3) the corresponding tertiary amines where again all the groups in the same molecule can be the same or different and (4) diamines such as N-octyl-1,2-ethylenediamine or the N-octyl-1,3-propylenediamine, N-coco-1,2-ethylenediamine or the N-coco-1,3-propylenediamine, N-oleyl-1,2-ethylenediamine, or N-oleyl-1,3-propylenediamine, N-soya-1,2-ethylenediamine or the N-soya-1,3-propylenediamine and N-tallow-1,2-ethylenediamine or the N-tallow-1,3-propylenediamine. The secondary amines include N-ethyl-N-oleylamine, N-methyl-N-soyamine, and the tertiary amines include N, N-diethyl-N-oleylamine.

Alkoxylated amines included are bis(2-hydroxyethyl) oleylamine, bis(2-hydroxypropyl)oleylamine, bis(2-hydroxyethyl) tallowamine, bis(2-hydroxypropyl)tallowamine, (hydroxyethyl)(hydroxypropyl)tallowamine, polyethoxylated oleylamine (containing 7 ethoxyl groups) and polyethoxylated tallowamine (containing 3 ethoxyl groups). Included also are hydroxyalkyl amines made by the ethoxylation or propoxylation of hydrocarbyldiamines or hydrocarbyltriamines. Specifically included are aromatic and alkyl- or alkylene-substituted aromatic groups containing 6 to 30 carbon atoms. Further included are alkoxyalkylamines, such as dodecyloxypropylamine and triisodecyloxypropylamine and similar oxygen-containing amines, and the corresponding alkoxydiamines, such as the N-alkoxyhydrocarbylenediamines.

The reaction to form the borate ester can be carried out at from about 80° C. to about 260° C., preferably from about 110° C. to about 180° C. The temperature chosen will depend for the most part on the particular reactants and on whether or not a solvent is used. Reaction pressures can be vacuum, atmospheric or positive pressure. In carrying out this reaction, it is preferable that quantities of reactants be chosen such that the molar ratio of amine to boron compound be from about 0.2 to about 2, preferably from about 0.5 to about 0.9. The amine can be reacted with an excess of the borating species to form a borate amine containing from about 0.1% by weight of boron to as much as 10% or more of boron.

While atmospheric pressure is generally preferred, the reaction can be advantageously run at from about 1 to about 5 atmospheres. Furthermore, where conditions warrant it, a solvent may be used. In general, any relatively non-polar, unreactive solvent can be used, including benzene, toluene, xylene and 1,4-dioxane. Other hydrocarbon and alcoholic solvents, which include propanol, butanol, hexamethylene glycol and the like, can be used. Mixtures of alcoholic and hydrocarbon solvents can be used also.

The times for the reactions are not critical. Thus, any phase of the process can be carried out in from about 1 to about 20 hours.

A narrow class of thickening agents is preferred to make the grease of this invention. Included among the preferred thickening agents are those containing at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides and esters containing 12-hydroxystearates, 14-hydroxystearic acid, 16-hydroxystearic acid and 6-hydroxystearic acid.

The entire amount of thickener need not be derived from the aforementioned preferred members. Significant benefit can be attained using as little thereof as about 15% by weight of the total thickener. A complementary amount, i.e., up to about 85% by weight of a wide variety of thickening agents can be used in the grease of this invention. Included among the other useful thickening agents are alkali and alkaline earth metal soaps of methyl-12-hydroxystearate, diesters of a $C_4$ to $C_{12}$ dicarboxylic acid and tall oil or marine oil fatty acids. Other alkali or alkaline earth metal fatty acids containing from 12 to 30 carbon atoms and no free hydroxyl may be used. These include soaps of stearic and oleic acids.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyamines, indanthrene, pigments such as perylimides, pyromellitdiimides, and ammeline, as well as certain hydrophobic clays. These thickening agents can be prepared from clays which are initially hydrophilic in character, but which have been converted into a hydrophobic condition by the introduction of long-chain hydrocaron radicals into the surface of the clay particles prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

Manufacture of the thickening agents can be done in a variety of grease making equipment such as in open kettles at reduced, atmospheric, or positive pressures; in higher pressure reaction chambers which may be operated to as high as 180 psig; or in continuous manufacturing equipment. The temperature range from the bulk grease under manufacture can range from 15° C. (60° F.) to 238° C. (460° F.).

The third member(s) that may be present in the grease composition are the phosphorus and sulfur moieties. Both of these can be present in the same molecule, such as in a metal or non-metal phosphorodithioate of the formula $$\left[(R^6O)_2\overset{\overset{Z}{\|}}{P}Z\right]_n M$$

wherein $R^6$ is a hydrocarbyl group containing 3 to 18 carbon atoms, M is a metal or non-metal, n is the valence of M and X is oxygen or sulfur, at least one Z being sulfur.

In this compound, $R^6$ is preferably an alkyl group and may be a propyl, butyl, pentyl, hexyl, octyl, decyl, dodecyl, tetradecyl or octadecyl group, including those derived from propanol, isopropanol, butanol, isobutanol, sec-butanol, 4-methyl-2-pentanol, 2-ethylhexanol, oleyl alcohol, and mixtures thereof. Further included are alkaryl groups such as butylphenyl, octylphenyl, nonylphenyl and dodecylphenyl groups.

The metals covered by M include those in Groups IA, IIA, IIB and VIII of the Periodic Table. Some that may be mentioned are lithium, molybdenum, sodium, calcium, zinc, cadmium, silver and gold. Non-metallic ions include organic groups derived from vinyl esters such as vinyl acetate, vinyl ethers such as butyl vinyl ether, epoxides such as propylene oxide and 1,2-epoxydodecane and amine salts. They also include other nitrogenous compounds such as those derived from hydrocarbyl amines and diamines, including oleylamine and N-oleyl-1,3-propylenediamine and such as the imidazolines and oxazolines.

The phosphorus and sulfur can also be supplied from the combination of two separate compounds, such as the combination of (1) a dihydrocarbyl phosphite having 2 to 10 carbon atoms in each hydrocarbyl group or mixtures of phosphites and (2) a sulfide such as sulfurized isobutylene, dibenzyl disulfide, sulfurized terpenes, phosphorodithionyl disulfide and sulfurized jojoba oil. The phosphites embrace the dibutyl, dihexyl, dioctyl, didecyl and similar phosphites. Phosphate esters containing 4 to 20 carbon atoms in each hydrocarbyl group, such as tributyl phosphate, tridecyl phosphate, tricresyl phosphate and mixtures of such phosphates, can also be used.

In summary, it is essential to the practice of this invention, in which greases having vastly improved dropping points are obtained, that at least the first two of the above-mentioned ingredients be formulated into the composition. Thus:

first, with respect to the preparation of the grease, the thickener will have at least about 15% by weight of a metal or non-metal hydroxy-containing soap therein, the total thickener being from about 3% to about 20% by weight of the total grease composition;

second, there will be added to the grease from about 0.01% to about 10% by weight, preferably about 0.1% to about 2%, of the borated amine, in which the borated amine preferably has been reacted with at least an equimolar amount of a boron compound; and as a third component, the composition may have therein from 0.01% to about 10% by weight preferably, from 0.2% to 2% by weight of phosphorus- and sulfur-containing compounds or a mixture of two or more compounds which separately supply the phosphorus and sulfur moieties. If separate compounds are used, an amount of the mixture equivalent to the above concentration levels is used to supply desired amounts of phosphorus and sulfur.

It was noted that, when the hydroxy-containing thickener was used with the borated amine, the dropping point of the grease was consistently unexpectedly higher than with a grease from the same grease vehicle and the same borated amine, but with a different thickener, e.g., a non-hydroxy-containing thickener. Thus, the broad invention is to a grease composition comprising the two components mentioned.

In general, the reaction products of the present invention may be employed in any amount which is effective for imparting the desired degree of friction reduction, antiwear activity, antioxidant activity, high temperature stability or antirust activity. In many applications, however, the borated amine and the phosphorus- and/or sulfur-containing compound(s) are effectively employed in combined amounts of from about 0.02% to about 20% by weight, and preferably from about 0.2% to about 4% of the total weight of the composition.

The greases of the present invention can be made from either a mineral oil or a synthetic oil, or mixtures thereof. In general, mineral oils, both paraffinic, naphthenic and mixtures thereof, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. In making the grease, the lubricating oil from which it is prepared is generally employed in an amount sufficient to balance the total grease composition, after accounting for the desired quantity of the thickening agent, and other additive components to be included in the grease formulation.

In instances where synthetic oils are desired, in preference to mineral oils, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The metallic soap grease compositions containing one or more of the borated amines, and optionally, one or more of the sulfur and phosphorus combinations described herein provide advantages in increased dropping point, improved grease consistency properties, antirust characteristics and potential antifatigue, antiwear and antioxidant benefits unavailable in any of the prior greases known to us. The grease of this invention is unique in that it can be preferably manufactured by the admixture of additive quantities of the alcohol borates to the fully formed soap grease after completion of saponification.

The following Examples will present illustrations of the invention. They are illustrative only, and are not meant to limit the invention.

EXAMPLE 1

A mixture of 1295 g N-oleyl-1,3-propylenediamine (obtained as Duomeen O from Armak Chemical Co.), 218 g of xylene, 437 g of n-butanol, 658 g of hexamethylene glycol and 1210 g of boric acid were placed in a reactor equipped with heater, agitator and Dean-Stark tube with condenser, and refluxed for about 10 hours until all water formed in the reaction azeotroped over (maximum temperature was about 195° C.). The solvents were removed by vacuum distillation at 195° C. and the product was filtered and then diluted with an equal amount of 100 second process oil to form a 50% concentrate of borated diamine in mineral oil. The concentrate was an orange colored viscous liquid.

EXAMPLE 2

N-tallow-1,3-propylenediamine was obtained as Duomeen T from Armak Chemical Co. and borated with boric acid as generally described in Example 1. For convenience of handling the borated N-tallow-1,3-propylenediamine was blended with an equal wt. of 100 second process oil to form a 50% concentrate in mineral oil.

EXAMPLE 3

A lithium hydroxystearate grease thickener was prepared by saponification of a mixture containing 12-hydroxystearic acid (8%) and the glyceride thereof (9%) with lithium hydroxide in a mineral oil vehicle at about 177° C. in a closed contactor.

EXAMPLE 4

After depressuring and dehydration of the thickener in an open kettle sufficient mineral oil was added to reduce the thickener content to about 9.0%. After cooling to about 99° C., a typical grease additive package, consisting of an amine antioxidant, phenolic antioxidant, metallic dithiophosphate (1.5 wt % of zinc dialkyl phosphorodithioate, where the alkyl is derived from a mixture of $C_3$ to $C_6$ primary alcohols), sulfur-containing metal deactivator and nitrogen containing antirust additives, was added.

EXAMPLE 5

To the base grease of Example 4, was added at about 110° C., 0.5 wt % of the borated N-oleyl-1,3-propylenediamine of Example 1.

EXAMPLE 6

To the base grease of Example 4 was added, at about 115° C., 1.0 wt % of the borated N-tallow-1,3-propylenediamine of Example 2.

EXAMPLE 7

To the base grease of Example 3 was added 0.5 wt. % of the borated N-oleyl-1,3-propylenediamine of Example 1.

EXAMPLE 8

Same as Example 7, except 2% of borated amine was used.

EXAMPLE 9

Base grease thickened with the lithium soap of 50/50 (wt) mixture of stearic and palmitic acids, which are non-hydroxy-containing thickeners.

EXAMPLE 10

50 wt. % of the base grease used in Example 4 plus 50 wt. % of the grease of Example 9, producing a 50-50 mixture of hydroxy- and non-hydroxy-containing thickeners.

EXAMPLE 11

Base grease of Example 9 containing 2 wt. % of the borated amine of Example 2.

EXAMPLE 12

To a mineral oil grease thickened with 9.5 wt. % of a lithium 12-hydroxystearate soap thickener is added 0.62 wt. % of a borated N-coco-1,3-propylenediamine. The "coco" is a mixture of $C_6$ (0–0.8% , $C_8$ (5–9%), $C_{10}$ (6–10%), $C_{12}$ (44–52%), $C_{14}$ (13–19%), $C_{16}$ (8–11%), $C_{18}$ sat. (1–3%), $C_{18}$ mono-unsat. (5–8%), $C_{18}$ di-unsat. (trace-2%) and $C_{20}$ (0–0.4%).

Results obtained in the ASTM D2265-78 grease dropping point test are shown in the following Table 1.

TABLE 1

| SAMPLE | D2265 Dropping Point, °C. |
|---|---|
| Example 3 | 199 |
| Example 4 | 200 |
| Example 5 | 310 |
| Example 6 | 300 |
| Example 7 | 236 |
| Example 8 | 258 |
| Example 9 | 209 |
| Example 10 | 190 |
| Example 11 | 207 |
| Example 12 | 231 |

Examples 5 and 6 show a significant effect upon dropping point improvement when borated amine is added to hydroxy-containing carboxylate soap thickened grease in the presence of a phosphorus and sulfur source. Examples 7, 8 and 12 show a significant effect upon hydroxy-containing carboxylate soap thickened grease when the described borated amines are used alone. Clearly, the data show that the broad inventive concept of treating a hydroxide-thickened grease with a borated amine substantially increases the measured dropping point by at least about 30° C. (86° F.). This advantageous combination of the two components, the hydroxy carboxylate and borated amine, enables the greases to be considered high temperature greases. Thus, a significant technical advantage, in the hydroxy-containing carboxylate soap thickened greases, is achieved with this embodiment of the invention.

Examples 9, 10 and 11 clearly show no benefit of the borated amine upon the dropping point of a non-hydroxy-containing carboxylate soap thickened grease. This supports the unexpected advantage of combining the hydroxy-containing carboxylate soap and the borated amine to achieve the dropping point improvement.

What is claimed is:

1. A method of improving the dropping point of a grease composition comprising blending a major proportion of (1) a grease vehicle, (2) from about 0.01% to about 10% by weight of a means for increasing the dropping point of the grease composition comprising the reaction product made by reacting an amine of the formula

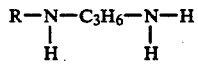

wherein R is a hydrocarbon group containing from 6 to 20 carbon atoms with boric acid, and (3) a thickener containing at least about 15% by weight of a 12-hydroxy-stearate thickener.

2. The method of claim 1 in which the composition additionally contains from about 0.01% to about 10% by weight of a compound containing both phosphorus and sulfur or a mixture of phosphorus-containing and sulfur-containing compounds to supply an equivalent amount of phosphorus and sulfur.

3. The method of claim 1 in which the amine is N-coco-1,3-propylenediamine.

4. The method of claim 1 in which the composition contains additionally a phosphorothioate of the formula

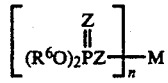

wherein $R^6$ is a hydrocarbyl group containing 3 to 18 carbon atoms, M is a metal or non-metal, n is the valence of M and Z is oxygen or sulfur, at least one Z being sulfur.

5. The method of claim 4 wherein $R^6$ is an alkyl group or an alkaryl group.

6. The method of claim 4 wherein $R^6$ is a propyl, butyl, pentyl, hexyl, octyl, dodecyl, tetradecyl, octadecyl, butylphenyl, octylphenyl, nonylphenyl, dodecylphenyl or oleyl group or a mixture thereof.

7. The method of claim 4 wherein $R^6$ is derived from propanol, isopropanol, butanol, isobutanol, sec-butanol, 4-methyl-2-pentanol, 2-ethylhexanol or a mixture thereof.

8. The method of claim 4 wherein M is a metal from Group IA, IIA, IIB or VIII of the Periodic Table.

9. The method of claim 4 wherein the metal is lithium, sodium, silver, molybdenum, calcium, zinc, cadmium or gold.

10. The method of claim 4 wherein M is derived from vinyl acetate, butyl vinyl ether, propylene oxide, 1,2-epoxydodecane or nitrogen-containing compound.

11. The method of claim 1 in which the composition further contains a combination of (1) a dihydrocarbyl phosphite having 2 to 6 carbon atoms in each hydrocarbyl group, mixtures of such phosphites, or a phosphate ester having 4 to 20 carbon atoms in each hydrocarbyl group and (2) a sulfide selected from sulfurized isobutylene, dibenzyl disulfide, sulfurized terpenes, phosphorodithionyl disulfide and sulfurized jojoba oil.

12. The method of claim 11 wherein the phosphite is a dibutyl, dihexyl, dioctyl or didecyl phosphite or mixtures thereof.

13. The method of claim 11 wherein the phosphate ester is a tributyl, tridecyl or tricresyl phosphate or mixtures thereof.

14. The method of claim 1 wherein the amine is N-coco-1,3-propylenediamine, the boron compound is boric acid, the thickener is 12-hydroxystearate and the phosphorus and sulfur are supplied by zinc $C_3$ to $C_6$ alkyl phosphorodithioate.

15. The method of claim 1 wherein the grease vehicle is a mineral oil.

16. The method of claim 1 wherein the grease vehicle is a synthetic oil.

17. The method of claim 1 wherein the grease vehicle is a mixture of mineral and synthetic oils.

18. The method of claim 1 which further comprises adding a phosphorus-containing compound.

19. In a method of making a grease wherein a soap of 12-hydroxystearic acid is the grease thickener wherein the improvement comprises mixing a major proportion of a grease vehicle with from about 0.01% to about 10% by weight of a means for increasing the dropping point of a grease made by reacting an amine of the formula $$R-\underset{\underset{H}{|}}{N}-C_3H_6-\underset{\underset{H}{|}}{N}-H$$

wherein R is a hydrocarbon group containing from 6 to 20 carbon atoms with boric acid, and thickening said grease with a thickener containing at least about 15% by weight of a 12-hydroxystearate thickener.

20. The method of claim 19 comprising adding from about 0.01% to about 10% by weight of a compound containing both phosphorus and sulfur or a mixture of phosphorus-containing and sulfur-containing compounds.

21. The method as described in claim 19 in which the amine is N-coco-1,3-propylene-diamine.

22. The method as described in claim 19 in which the grease vehicle is a synthetic oil, a mineral oil or a combination of synthetic and mineral oils.

23. The method of claim 19 which further comprises adding a phosphorus-containing compound.

* * * * *